US007883182B2

(12) United States Patent
Van Lierop et al.

(10) Patent No.: US 7,883,182 B2
(45) Date of Patent: Feb. 8, 2011

(54) FLUID EJECTION DEVICE FOR INK JET HEADS

(75) Inventors: Diederik Van Lierop, Weert (NL); Antonius Johannes Maria Nellissen, Horst (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 182 days.

(21) Appl. No.: 12/297,238

(22) PCT Filed: Apr. 10, 2007

(86) PCT No.: PCT/IB2007/051269

§ 371 (c)(1), (2), (4) Date: Oct. 15, 2008

(87) PCT Pub. No.: WO2007/122529

PCT Pub. Date: Nov. 1, 2007

(65) Prior Publication Data

US 2009/0303291 A1 Dec. 10, 2009

(30) Foreign Application Priority Data

Apr. 21, 2006 (EP) ..... 06112904

(51) Int. Cl.
*B41J 2/04* (2006.01)

(52) U.S. Cl. ..... 347/54

(58) Field of Classification Search ..... 347/54, 347/50, 56–59, 61–65, 40, 42, 44, 46, 47, 347/20, 19

See application file for complete search history.

(56) References Cited

U.S. PATENT DOCUMENTS

| | | | | |
|---|---|---|---|---|
| 6,406,130 | B1 | 6/2002 | Gooray et al. | |
| 2002/0191040 | A1 * | 12/2002 | Tanaka | 347/54 |
| 2004/0150694 | A1 * | 8/2004 | Kim et al. | 347/54 |
| 2004/0252164 | A1 * | 12/2004 | Jung | 347/54 |
| 2005/0104941 | A1 | 5/2005 | Tanaka | |

FOREIGN PATENT DOCUMENTS

| | | | |
|---|---|---|---|
| EP | 1208982 | A1 | 5/2002 |
| EP | 1364791 | A1 | 11/2003 |
| JP | 10193600 | A | 7/1998 |
| JP | 2002273872 | A | 9/2002 |
| JP | 2003266695 | A | 9/2003 |

* cited by examiner

*Primary Examiner*—K. Feggins
(74) *Attorney, Agent, or Firm*—Larry Liberchuk

(57) ABSTRACT

A fluid ejection device that can be used for inkjet heads is described. A large actuator with a small stroke in combination with hydraulic pressure transfer by means of essentially relatively incompressible fluid is used in order to generate a large stroke of a small membrane. Further the ink is ejected during the actuation phase of the actuator enabling a better control of the droplet dynamics.

11 Claims, 6 Drawing Sheets

FLUID EJECTION DEVICE FOR INK JET HEADS

Figure 1A:
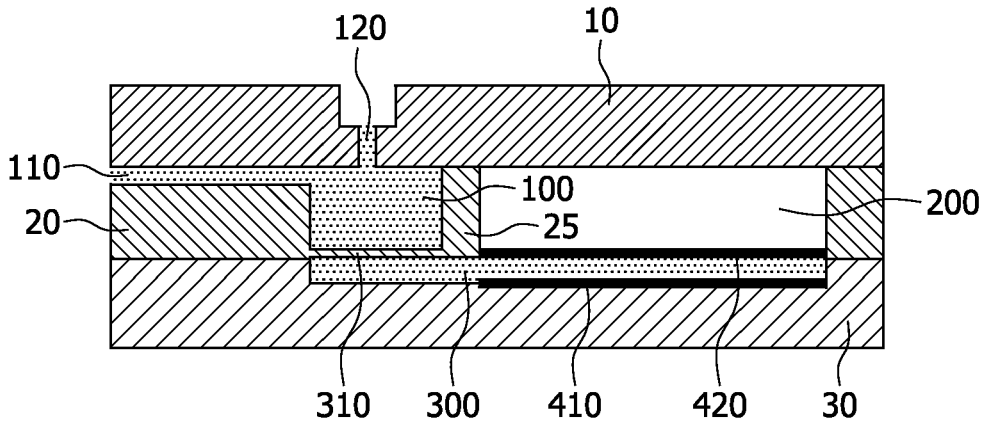

The present invention is related to a fluid ejection device for ink jet heads.

Fluid ejection devices for ink jet heads are described in EP 1208982. The fluid ejector includes a sealed dual diaphragm arrangement, an electrode arrangement that is parallel and opposite to the sealed diaphragms, and a structure, which contains the fluid to be ejected. A diaphragm chamber containing a relatively incompressible fluid is situated behind, and is sealed by, the diaphragms. At least one nozzle hole is formed in a faceplate of the ejector over one of the diaphragms. A drive signal is applied to at least one electrode of the electrode arrangement to generate an electrostatic field between the electrode and a first one of the diaphragms. The first diaphragm is attracted towards the electrode by an electrostatic force into a deformed shape due to the electrostatic field. Upon deforming, pressure is transmitted to a second one of the sealed diaphragms. The transmitted pressure and the relatively incompressible nature of the fluid contained within the sealed diaphragm chamber causes the second diaphragm to deflect in the opposite direction to force fluid through at least one of the at least one nozzle hole. After a drop is ejected, the movement is reversed, either through normal resilient restoration actions of the deformed diaphragm and/or through an applied force generated by the other electrode. The diaphragm arrangement is placed within the structure containing the fluid to be ejected. One diaphragm deflects up and the other one down due to the transmission of the pressure by means of the relatively incompressible fluid in the sealed diaphragm chamber. The working in opposite direction of the two diaphragms causes negative interference and consequently limitations in the control of droplet dynamics.

It is an objective of the present invention to provide a fluid ejection device with improved control of the droplet dynamics.

The objective is achieved by means of a fluid ejection device, comprising an ejection chamber with at least one opening on at least one side of the ejection chamber and a first membrane covering another side of the ejection chamber, a decoupling chamber separated from the ejection chamber and covered on one side with a second membrane, a transmission chamber separated from the ejection chamber and from the decoupling chamber and being partly bounded by the first membrane and the second membrane, the transmission chamber is filled with an relatively incompressible fluid, and means to apply a force to the first membrane and/or the second membrane. If a force is applied to e.g. the second membrane the second membrane deflects and exerts a pressure on the incompressible fluid. The incompressible fluid transfers the pressure to the first membrane; the first membrane deflects in the opposite direction as the second membrane that means if the second membrane deflects into the volume of the transmission chamber the first membrane deflects outwards with respect to the volume of the transmission chamber. If the ejection chamber is filled with a fluid, the first membrane exerts a pressure to the fluid in the ejection chamber causing the ejection of the fluid via the at least one opening. The deflection of the second membrane does influence the fluid in the ejection chamber only via the fluid in the transmission chamber and the first membrane since the second membrane has no common border with the ejection chamber. The direct interaction of the second membrane with the fluid to be injected disturbing the dynamics of the fluid as in the prior art isn't possible. An excellent control of the dynamic of the ejection by means of the characteristics (shape of the pulse) of the force applied to the second membrane is possible. The elastic properties of the material or the materials building the first membrane and the second membrane result in a pull back force if no force is applied to the second membrane causing under-inflation in the ejection chamber via the incompressible fluid in the transmission chamber and the first membrane. The under-inflation can be used to refill the ejection chamber with the fluid to be ejected by means of a supply tube connected to the ejection chamber via a second opening and the supply tube is further connected with a reservoir filled with the fluid to be ejected. Further a large stroke of the first membrane can be achieved if the force applied to the second membrane scales with the size of the area of the second membrane. A small stroke of the large second membrane causes then a large stroke of the first membrane. In addition means can be provided to apply a force to the first membrane. The means to apply force to the first and the second membrane can be in a way that as well inward movement as outward movement of the first and the second membrane with respect to the inside of the transmission chamber can be stimulated further improving the control of the fluid dynamic during the ejection of fluid. The means can be electrodes contacted to a voltage supply in order to use electrostatic force for the ejection, coils connected to a power supply in order to use electromagnetic force, thin piezo layers attached to the membrane, or thermal bimorphs. The filling of the decoupling chamber shall be highly compressible or the decoupling chamber shall be connected to atmospheric pressure to allow for a large deflection of the second membrane. If there is a fluid within the decoupling chamber, the decoupling chamber has to be connected to a pressure balance chamber with a compressible volume.

In one embodiment of the current invention the ejection chamber has at least two openings, a first opening for ejecting or pumping a fluid out of the ejection chamber and a second opening connected to a supply tube to refill the ejection chamber with the fluid. The at least one second opening can be connected to a fluid reservoir by means of the supply tube. If the fluid in the ejection chamber is ejected the at least one first opening is preferably a nozzle. If the fluid in the ejection chamber is pumped, the at least one first opening is preferably connected to a tube. Valves can be attached to the openings in order to control the flow through the openings.

In a further embodiment of the invention at least one first electrode is attached to the second membrane, and at least one second electrode is attached to the border of the transmission chamber applying an electrostatic force to the first electrode attached to the second membrane by means of a voltage source connected to the electrodes. The electrodes and the voltage source form the means to apply a force to the second membrane. The electrostatic force between the first and the second electrode actuates the second membrane and causes an ejection of the fluid to be ejected via the incompressible fluid and the first membrane as described above. The first electrode attached to the second membrane can be an electrically conductive structure on one of the surfaces of the second membrane or the first electrode attached to the second membrane can form the first membrane itself. In this case the first membrane is built by means of a layer of conductive material. The first electrode attached to the second membrane and/or the second electrode can be covered by means of an isolating material in order to prevent short circuits and to enlarge the maximum voltage that can be applied to the electrodes. The second electrode preferably faces the first electrode in order to generate a maximum electrostatic actuation at a given voltage applied to both electrodes.

In a further embodiment of the invention a third electrode is attached to the border of the transmission chamber facing the first membrane, the second electrode faces the second membrane, the first electrode extends across the first membrane and the second membrane facing the second electrode and the third electrode and an electrostatic force can be applied to the first membrane. If a voltage is applied between the first electrode and the second electrode the third electrode is essentially on the same electrical potential as the first electrode otherwise the actuation of both membranes at the same time would work against each other. The second membrane is attracted causing an ejection of the fluid to be ejected via the incompressible fluid in the transmission chamber and the first membrane as described above. In the following step a voltage is applied between the first electrode and the third electrode whereby the electrical potential of the second electrode is essentially the same as the electrical potential of the first electrode. The first membrane is attracted and actively supports the pull back of the second membrane in order to enable a shorter actuation cycle of the fluid ejection device.

In a further embodiment of the invention a third electrode is attached to the first membrane and the second electrode faces the first membrane and the second membrane. Again both membranes can be actuated independently by means of a voltage source connected to the electrodes as described above.

In a further embodiment of the invention a third electrode is attached to the border of the transmission chamber facing the first membrane, a fourth electrode is attached to the first membrane, the second electrode faces the second membrane. Again both membranes can be actuated independently by means of a voltage source connected to the electrodes as described above.

All statements given above with respect to the nature of the membranes and the isolation of the electrodes and the properties of the incompressible fluid in the transmission chamber are also applicable to these embodiments.

In a further embodiment at least one pull back electrode is provide beside the first electrode being attached to the second membrane. The pull back electrode is attached to a side of the border of the decoupling chamber and a voltage source is provided to apply a voltage between the first electrode attached to the second membrane and the pull back electrode so that a pull back electrostatic force can be applied to the second membrane. The electrostatic force between the pull back electrode and the first electrode attached to the second membrane pulls back the second membrane after the ejection of the fluid to be ejected caused by the attraction of the second membrane by means of the voltage between the first electrode attached to the second membrane and the second electrode attached to the border of the transmission chamber facing the first electrode enabling a better control of the fluid ejection device and a faster duty cycle. During the pull back of the second membrane the voltage between the first and the second electrode is preferably set to zero and a voltage is applied between the first electrode and the pull back electrode in order to generate a maximum pull back force.

Again all statements given above with respect to the nature of the membranes and the isolation of the electrodes and the properties of the incompressible fluid in the transmission chamber are also applicable to this embodiment.

In a further embodiment of the invention at least one electrode is attached to a side of the border of the ejection chamber and/or the decoupling chamber beside the at least three electrodes at the border of the transmission chamber. The at least one electrode attached to a side of the border of the ejection chamber and/or the decoupling chamber faces the electrode or electrodes being attached to the first membrane and/or the second membrane. If the at least one electrode is only attached to the border of the decoupling chamber facing the electrode attached to the second membrane it enables to pull back the second membrane after ejection as described above but with the support of the actuation of the first membrane in order to improve the control of the ejection process. If the at least one electrode is attached to the border of the ejection chamber facing the electrode attached to the first membrane, the electrode attached to the border of the ejection chamber can be used to amplify the ejection. The additional pull of the first membrane by providing a voltage source to apply a voltage between the electrode attached to the border of the ejection chamber and the electrode being attached to the first membrane adds to the push of the first membrane caused by the actuation of the second membrane by applying a voltage between an electrode attached to the second membrane and an electrode attached to the border of the transmission chamber facing the electrode attached to the second membrane and the transfer of the pressure to the first membrane via the incompressible fluid. The electrode attached to the border of the transmission chamber facing the electrode on the first membrane is during the ejection of the fluid to be ejected on the same electrical potential as the electrode on the first membrane. A further option is that the at least one further fourth electrode extends across the ejection chamber and the decoupling chamber facing two separate electrodes a third electrode attached to the first membrane and a first electrode attached to the second membrane, and the third electrode and the first electrode on the other hand face one second electrode attached to the border of the transmission chamber. If the fourth electrode attached to the border of the ejection chamber and the decoupling chamber and the second electrode attached to the border of the transmission chamber are on different electrical potential and the third electrode attached to the first membrane is on the same electrical potential as the second electrode attached to the border of the transmission chamber and the first electrode attached to the second membrane is on the same electrical potential as the fourth electrode attached to the border of the first and decoupling chamber, the ejection of the fluid to be ejected can be amplified. The switching between ejection and pull back is controlled by means of the variation of the electrical potential of the third electrode attached to the first membrane and the first electrode attached to the second membrane or alternatively the variation of the electrical potentials of the fourth electrode attached to the border of the first and the decoupling chamber and the second electrode attached to the border of the transmission chamber. Further electrode configurations with adapted voltage driving resulting in a comparable ejection process are:

a) a second electrode and a third electrode being attached to the border of the transmission chamber facing a first electrode being attached to the second membrane and to the first membrane, and the first electrode being attached to the second membrane and to the first membrane faces a fourth electrode being attached to the border of the ejection chamber and a separate pull back electrode being attached to the border of the decoupling chamber.

b) a second electrode and a third electrode being attached to the border of the transmission chamber, the second electrode facing a first electrode only being attached to the second membrane and the third electrode being attached to the border of the transmission chamber facing a fourth electrode only being attached to the first membrane and the fourth electrode only being attached to the first membrane again faces a fifth electrode only being attached to the border of the ejection chamber and the first electrode only being attached to the second membrane again faces a separate pull back electrode only being attached to the border of the decoupling chamber.

Again all statements given above with respect to the nature of the membranes and the isolation of the electrodes and the properties of the incompressible fluid in the transmission chamber are also applicable to this embodiment.

The incompressible fluid filled in the transmission chamber can have a high permittivity in order to enlarge the pressure that can be applied to the incompressible fluid in the transmission chamber by means of the electrostatic actuation of the second membrane. Further the incompressible fluid should have a low electrical conductivity especially if there is no further isolation between the electrodes and the incompressible fluid. A material that can be used for this purpose is distilled water with a permittivity of around 78 and a low conductivity of $10^{-6}$ S/m. An additional protection against short circuits is at least one isolating layer between each pair of electrodes.

The electrical potentials of the electrodes in the different embodiments are only for illustrative purpose. More sophisticated voltage pulses can be applied to the electrodes in order to optimize the dynamic of the ejection.

It is a further objective to provide a printing system comprising a fluid ejection device with improved control of the droplet dynamics of the ejected ink.

The printing system comprises a fluid ejection device according to the present invention. The fluid ejection device is implemented in the print head of the printing system in order to eject the ink.

It is a further objective of the current invention to provide a method for driving a fluid ejection device with improved control of the droplet dynamics.

The fluid ejection device comprises an ejection chamber, a decoupling chamber and a transmission chamber, a first membrane partly bounding the transmission chamber and the ejection chamber, a second membrane partly bounding the decoupling chamber and the transmission chamber, and an essentially incompressible liquid filled in the transmission chamber, and the method for driving the fluid ejection device comprises the following steps:

applying a force to the second membrane;

transmitting the force applied the second membrane via the essentially incompressible liquid in the transmission chamber to the first membrane;

applying a force to a fluid to be ejected filled in the ejection chamber by means of the first membrane;

ejecting the fluid to be ejected filled in the ejection chamber through an opening.

A force can by applied directly to the first membrane by means of actuation means located at the first membrane or indirectly by means of the force applied to the second membrane and the transmission of this force via the essentially incompressible liquid. The ejection chamber is refilled with the fluid to be ejected by means of an under inflation in the ejection chamber caused by the elastic properties of the first membrane and the second membrane if no force is applied to the first membrane and the second membrane and force that is applied to the first membrane and/or the second membrane in the opposite direction as during the ejection of the fluid to be ejected.

It is further an objective of the current invention to provide an electrostatic or electromagnetic or thermally actuated ejection device with improved control of the droplet dynamics.

The ejection device can be used to eject a fluid through the at least one opening of the ejection chamber. The ejection chamber can be filled with a fluid by means of a supply pipe coming from a reservoir filled with the fluid connected to a second opening of the ejection chamber not used for ejection. After the ejection chamber is filled with the fluid a voltage is applied to the actuation electrode and the moveable electrode and a force is exerted to the flexible membrane enhancing the pressure of the fluid in the ejection chamber finally resulting in the ejection of the fluid to be ejected through the at least one opening of the ejection chamber whereby the opening preferably is a nozzle. The ejection chamber can then be refilled through the supply pipe and the second opening using the pull back of the flexible membrane optionally in combination with pressure applied to the fluid reservoir. In addition means as valves can be set aside for closing the opening where the fluid is ejected during the refilling of the ejection chamber. The ejection device can be used for transdermal drug delivery, printing circuits or printing polyLED. At least one opening of the ejection chamber is then characterized by being a nozzle and the fluid is a liquid drug or a liquid solution with a drug, a liquid conductor or a polymer. The ejection device can also be used to eject ink in a printing system. Again at least one opening of the ejection chamber is then characterized by being a nozzle and the fluid is ink. Further the ejection device can be used as a pump. In this case there are at least two openings one where the fluid flows in and one where the fluid flows out. Additional means as valves can close the opening where the fluid flows out as long as the opening, where the fluid flows in, is open and vice versa. Further tubes can be connected to the openings in order to pump the fluid.

Figure 1B:
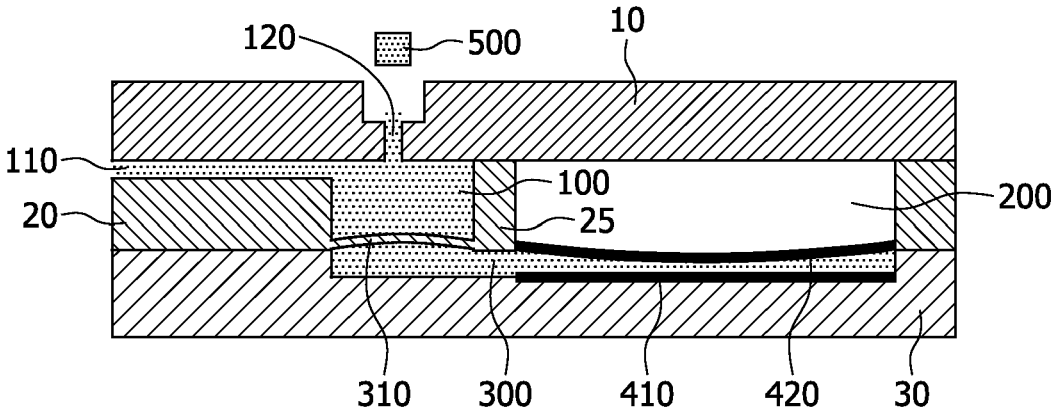
Figure 2:
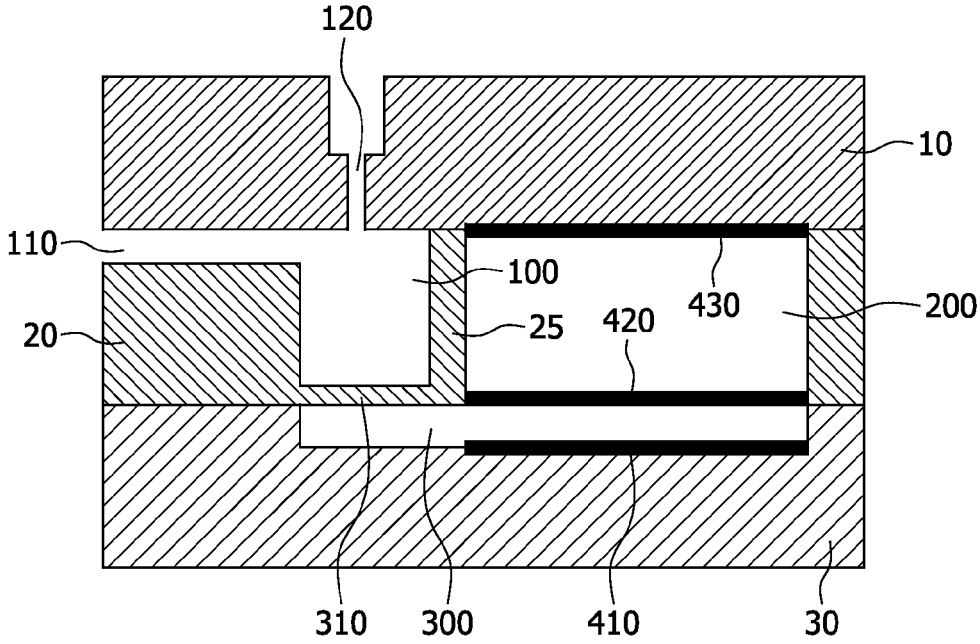
Figure 3:
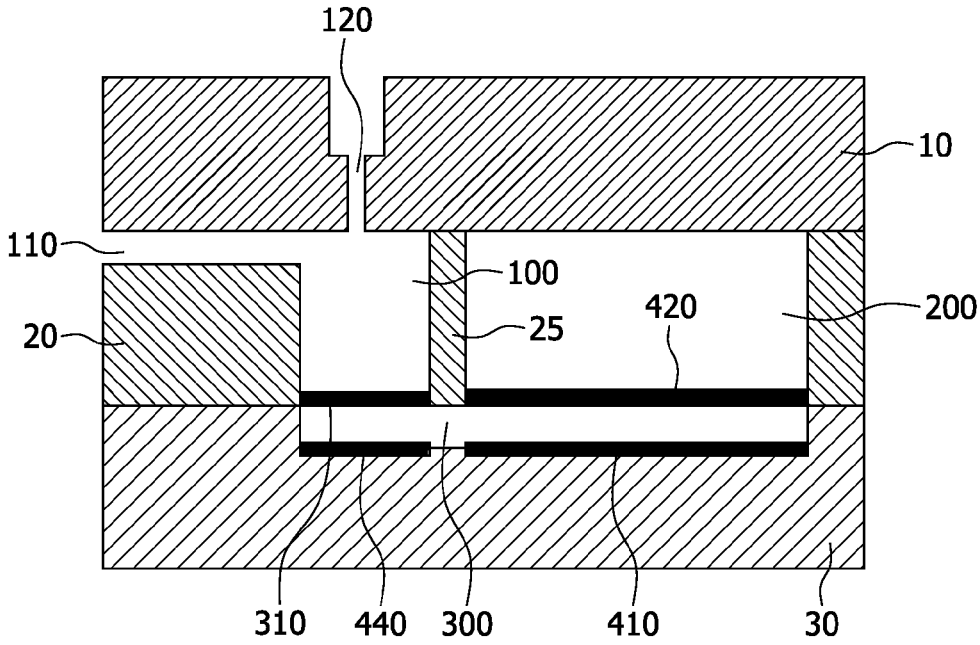
Figure 4:
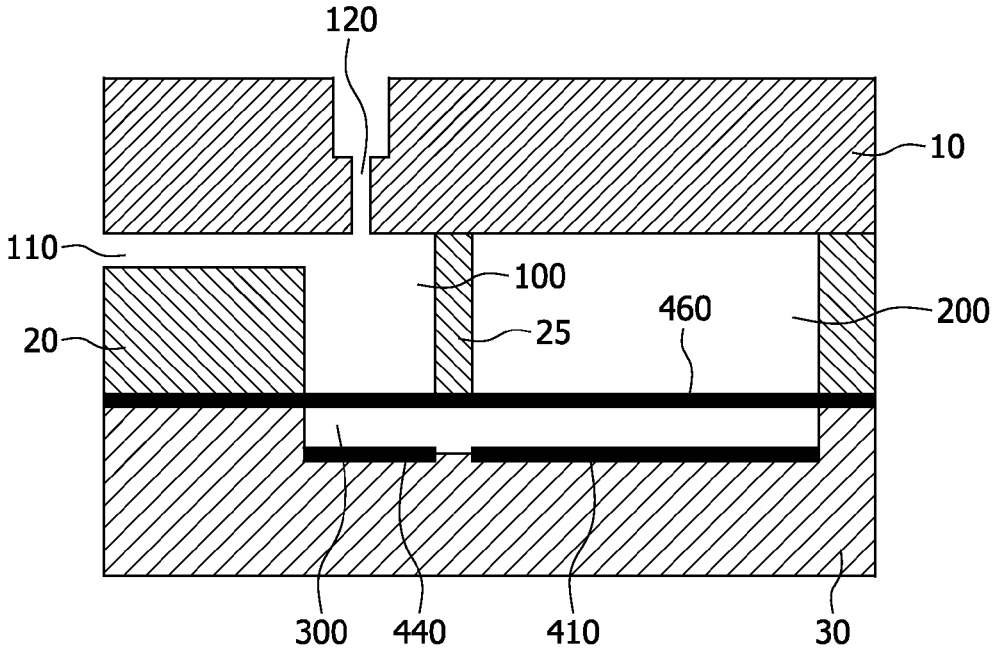
Figure 5:
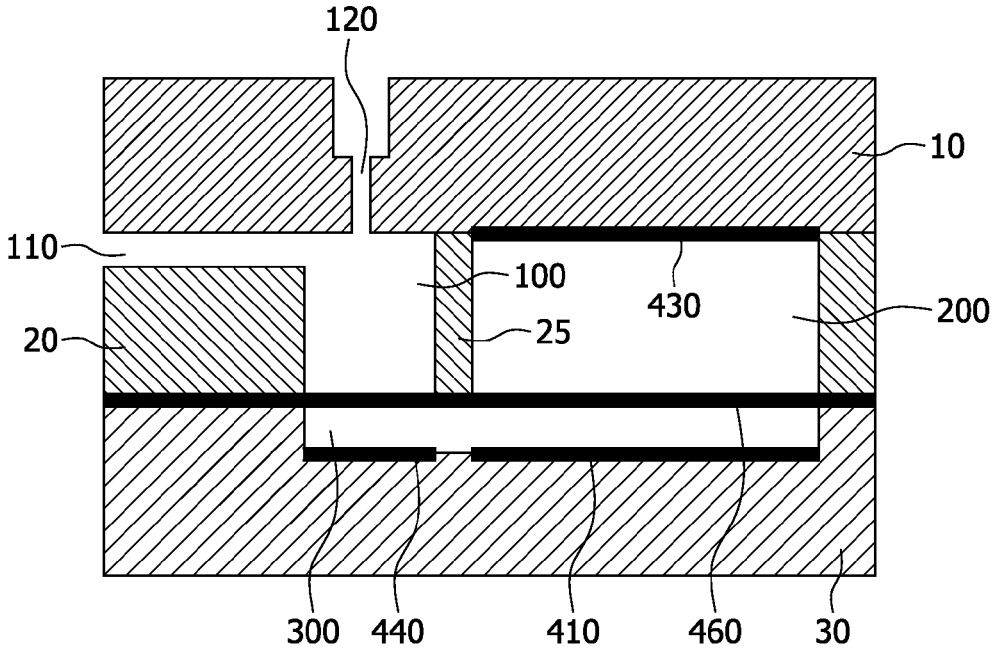
Figure 6:
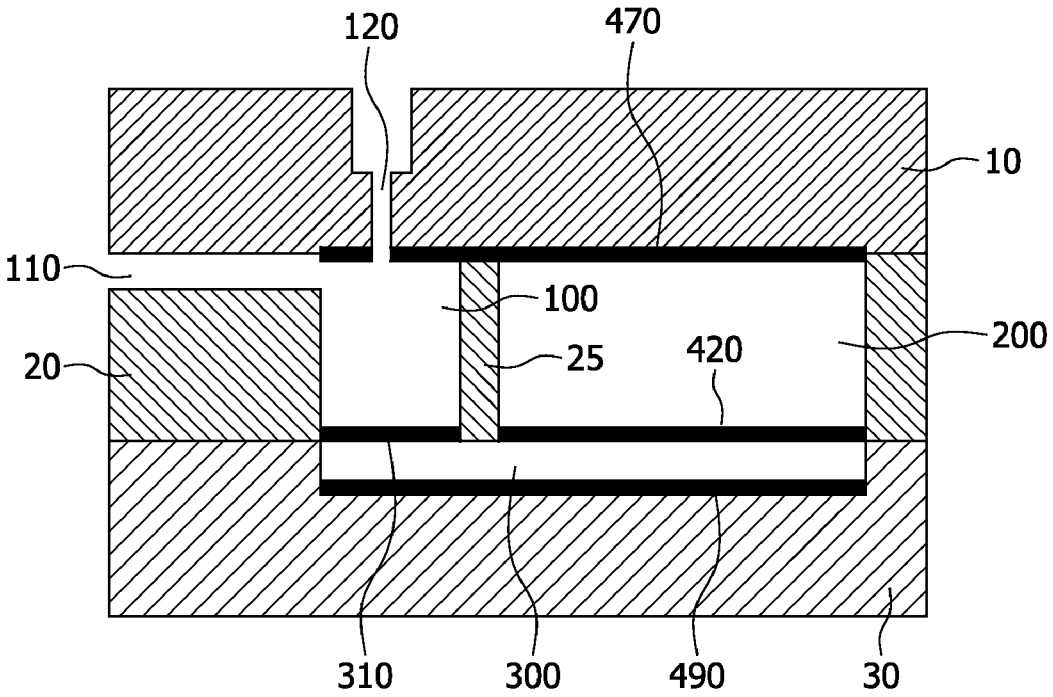

The present invention will now be explained in greater detail with reference to the figures, in which similar parts are indicated by the same reference signs, and in which:

FIGS. 1*a* and 1*b* show one embodiment of an ejection device according to the current invention FIG. 2 shows a second embodiment of the current invention FIG. 3 shows a third embodiment of the current invention FIG. 4 shows a fourth embodiment of the current invention FIG. 5 shows a fifth embodiment of the current invention FIG. 6 shows a sixth embodiment of the current invention FIG. 7*a*-7*d* show the processing of one embodiment of the current invention FIG. 1*a* and 1*b* show a cross section of a first embodiment of the current invention and the concept of hydraulic pressure transfer. In FIG. 1*a* the fluid to be ejected is filled in a ejection chamber 100 via a supply tube 110 connected to the ejection chamber both are built by means of recesses in a second substrate 20 and by means of a first substrate 10. The supply tube 110 is connected with a fluid reservoir (not shown). The ejection chamber 100 has an opening or nozzle 120 etched or drilled in the first substrate 10 and is on one side bounded by a first membrane 310 facing the opening 120. Further there is a decoupling chamber 200 also built by means of a recess in the second substrate 20 and filled with a compressible gas such as air (vacuum is also possible). The decoupling chamber 200 is separated from the ejection chamber by means of a separator 25 and is bounded on one side by a second membrane 420 and on the other side facing the second membrane by the first substrate 10. The second membrane 420 consist of an electrically conductive material or the combination of one or more electrically isolating layer or layers and at least one electrically conductive layer building a first electrode. The transmission chamber 300 is built by means of a recess in a third substrate 30 and the first membrane 310 and the second membrane 420 are part of the boundary of the transmission chamber 300. The transmission chamber 300 is filled with a relatively incompressible fluid preferably having a high permittivity, e.g. distilled water. A second electrode 410 is attached to the boundary of the transmission chamber facing the second membrane. In FIG. 1*b* a voltage is applied between the part of the second membrane 420 building the first electrode and the second electrode 410 facing the second membrane 420. The second membrane 420 is attracted by means of the electrostatic force between the first and the second electrode towards the electrode 410 and a pressure is exerted to the incompressible fluid in the transmission chamber 300. The pressure is transferred by means of the incompressible fluid to the first membrane 310. The first membrane 310 deflects inside the volume of the ejection chamber 100 exerting a pressure to the fluid to be ejected in the ejection chamber 100 resulting in the ejection of a droplet 500 of the fluid to be ejected out of the opening 120. After the ejection of the droplet 500 the voltage between the second membrane 420 and the electrode 410 is switched off and the second membrane 420 deflects back essentially to the position shown in FIG. 1*a* due to the mechanical properties of the second membrane 420 and/or an under-inflation in the decoupling chamber 200 in comparison to the transmission chamber 300. The movement of the second membrane 420 is again transferred to the first membrane 310 via the incompressible fluid in the transmission chamber 300 and the ejection chamber 100 is refilled with the fluid to be ejected via the supply tube 110. The ejecting and refilling procedure can be supported by means of a valve (not shown) opening or closing the supply tube 110 and/or a certain positive operating pressure in the fluid reservoir.

FIG. 2 shows a cross section of a second embodiment of the current invention. There is a further pull back electrode 430 attached to the boundary of the decoupling chamber 200. A voltage is applied between the pull back electrode 430 and the conductive part of the second membrane 420 building the first electrode after a droplet is ejected and the voltage between the second electrode 410 and the conductive part of the second membrane 420 building the first electrode is switched off or reduced (during the ejection there is less or no voltage between the pull back electrode 430 and the conductive part of the second membrane 420 building the first electrode). The electrostatic field between the pull back electrode 430 and the conductive part of the second membrane 420 building the first electrode supports the back deflection of the second membrane 420 and enables a better control about the fluid dynamics of the ejection device and a faster duty cycle.

In FIG. 3 shows a cross section of a third embodiment of the current invention shown where the electrically conductive part of the first membrane 310 building a fourth electrode faces a third electrode 440. Again the back deflection of the second membrane 420 can be supported by means of a voltage applied between the electrically conductive part of the first membrane 310 building the fourth electrode and the third electrode 440 after the fluid has been ejected and the voltage between the second electrode 410 and the electrically conductive part of the second membrane 420 building the first electrode is switched off (during the ejection there is no or reduced voltage between the third electrode 440 and the electrically conductive part of the first membrane 310 building the fourth electrode). The electrically conductive part of the first membrane 310 building the fourth electrode is attracted towards the third electrode 440 exerting a pressure on the fluid in the transmission chamber 300. The pressure is transferred to the second membrane 420 accelerating the back deflection of the second membrane 420 enabling a better control of the fluid dynamics of the ejection device and a faster duty cycle.

FIG. 4 shows a cross section of a special realization of the embodiment shown in FIG. 3. The electrically conductive layer 460 building a first electrode is located between the second substrate 20 and the third substrate 30. Parts of the electrically conductive layer 460 build the first membrane 310 and the second membrane 420. The working principle is the same as in FIG. 3 but the electrically conductive layer 460 building the first electrode can be fixed on one electrical potential e.g. ground and a second electrode 410 and a third electrode 440 facing the electrically conductive layer 460 building the first electrode are switched between the electrical potential of the electrically conductive layer 460 building the first electrode and a different electrical potential resulting in the ejection of fluid to be ejected or refilling of the ejection chamber 100.

FIG. 5 shows a cross section of a combination of the fourth embodiment shown in FIG. 4 and the second embodiment shown in FIG. 2 of the current invention. An additional pull back electrode 430 supports again the back deflection of the second membrane 420 being part of an electrical conductive layer 460 building a first electrode if the potential of the electrical conductive layer 460 building the first electrode (and the electrical potential of a second electrode 410) is different to the electrical potentials of the third electrode 440 and the pull back electrode 430.

FIG. 6 shows the cross section of a sixth embodiment of the invention. A fourth electrode 470 extends across the boundary of the ejection chamber 100 and the decoupling chamber 200 facing the electrically conductive first membrane 310 building a third electrode and facing the electrically conductive second membrane 420 building a first electrode. The electrically conductive first membrane 310 building the third electrode and the electrically conductive second membrane 420 building the first electrode face a second electrode 490 attached to the border of the transmission chamber 300. If the electrically conductive first membrane 310 building the third electrode has the same electrical potential as the second electrode 490 but a different electrical potential as the fourth electrode 470 and electrically conductive second membrane 420 building the first electrode, the first membrane is pushed inside the volume of the ejection chamber 100 by means of the pressure caused by the electrostatic attraction of the electrically conductive second membrane 420 building the first electrode being transferred by the incompressible fluid in the transmission chamber 300 and in addition it is electrostically attracted towards the fourth electrode 470 increasing the force exerted to the first membrane 310 and consequently increasing the pressure exerted to the fluid to be injected in the ejection chamber 100 resulting in higher ejection velocity. Switching of the electrical potential of the electrically conductive first membrane 310 building the third electrode and the electrically conductive second membrane 420 building the first electrode results in attraction of the electrically conductive first membrane 310 building the third electrode towards the second electrode 490 and the attraction of the electrically conductive second membrane 420 building the first electrode towards the fourth electrode 470 resulting in a refilling of the ejection chamber 100 as described in the fifth embodiment depicted by FIG. 5. Alternatively the electrical potentials of the second electrode 490 and the fourth electrode 470 can be switched.

Figure 7A:
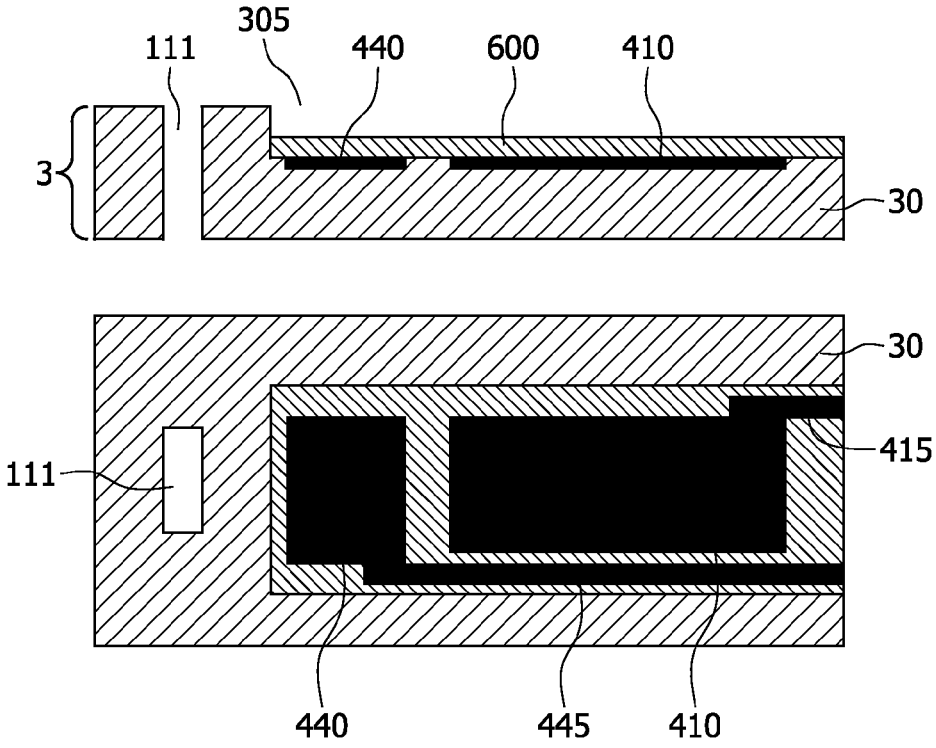
Figure 7B:
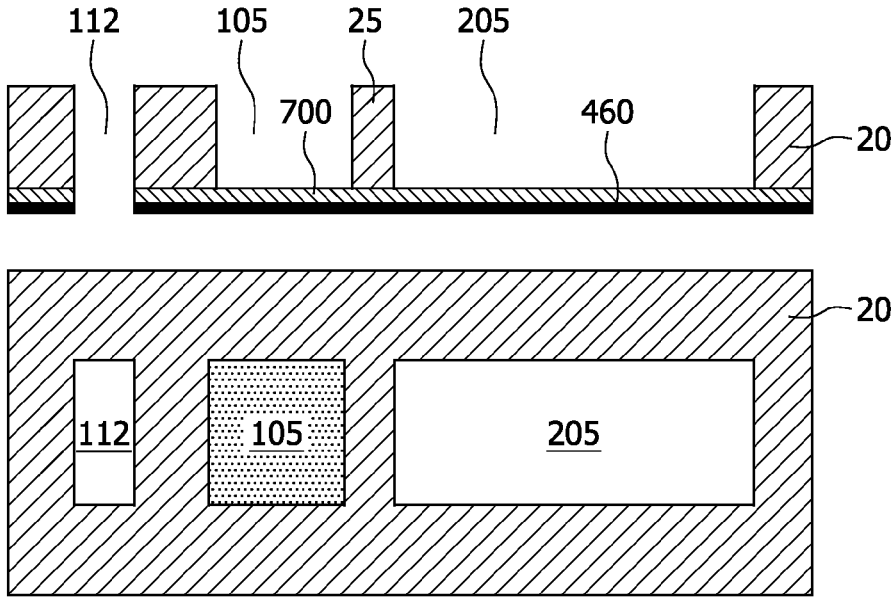
Figure 7C:
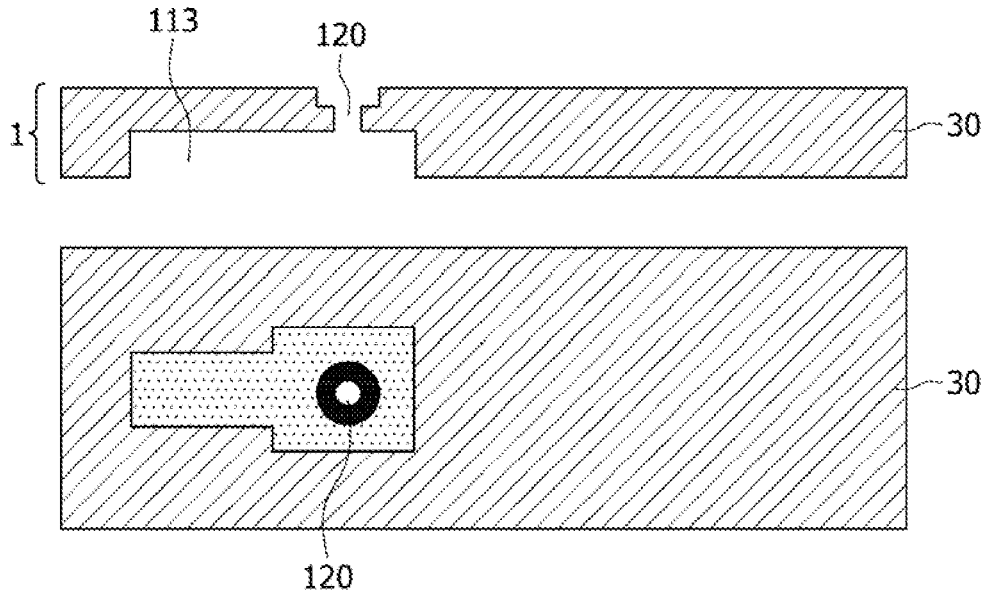
Figure 7D:
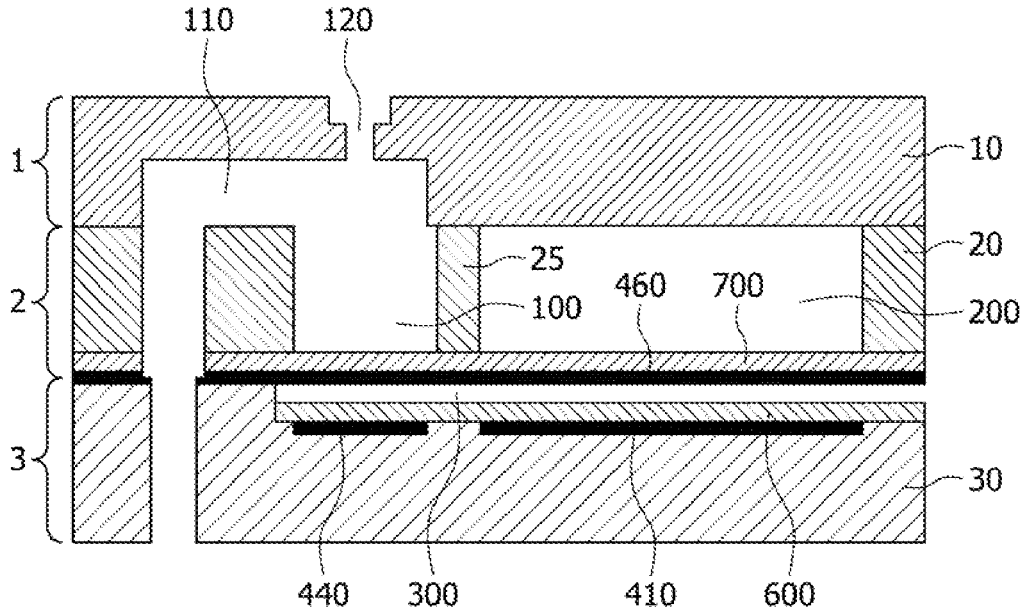

FIG. 7*a*-7*d* show one way of processing the fluid ejection device. In FIG. 7*a* the third substrate 30 made of e.g. Si, Pyrex glass or quartz is etched to get a recess 305 and a tube 111, Cr is deposited and structured resulting in a third electrode 440 and a second electrode 410 with electrically conductive connections 445 and 415. The electrically conductive structures 410, 415, 440 and 445 are isolated by means of the deposition of dielectric $SiO_2$-layer 600. The processed third substrate 30 is labeled with the number 3. On the second substrate 20 a membrane layer 700 consisting of Si, $Si_3N_4$, $SiO_2$, polyimide or silicone rubber and a conductive layer 465 made of e.g. Cr are deposited. The conductive layer 465, the membrane layer 700 and the second substrate 20 are etched in a way that a tube 112, a first electrode 460 and recesses 105 and 205 are formed whereby the recesses 105 and 205 are bounded on one side by the membrane layer 700 as shown in FIG. 7*b*. The processed second substrate 20 is labeled with the number 2. In FIG. 7*c* the first substrate 10 is etched to form the opening 120 and the recess 113 being connected to the opening 120. The processed first substrate 10 is labeled with the number 1. FIG. 7*d* shows the assembly of the three processed substrates 1, 2 and 3. The final device is comparable to fourth embodiment shown in FIG. 4 with an additional isolating dielectric $SiO_2$-layer 600, an additional membrane layer 700. The recesses 105 and 205 now bounded by the processed substrate 3 build the ejection chamber 100 and the decoupling chamber 200. The recess 305 now bounded by the processed substrate 2 builds the transmission chamber 300 after filling with an incompressible fluid and sealing. The supply tube 110 is build by the tube 111, 112 and a part of the recess 113.

The present invention will be described with respect to particular embodiments and with reference to certain drawings but the invention is not limited thereto but only by the claims. Any reference signs in the claims shall not be construed as limiting the scope. The drawings described are only schematic and are non-limiting. In the drawings, the size of some of the elements may be exaggerated and not drawn on scale for illustrative purposes. Where the term "comprising" is used in the present description and claims, it does not exclude other elements or steps. Where an indefinite or definite article is used when referring to a singular noun e.g. "a" or "an", "the", this includes a plural of that noun unless something else is specifically stated.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, first, second and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

The invention claimed is:

1. A fluid ejection device, comprising an ejection chamber (100) with at least one opening (120) on at least one side of the ejection chamber and a first membrane (310) covering another side of the ejection chamber, a decoupling chamber (200) separated from the ejection chamber (100) and covered on one side with a second membrane (420), a transmission chamber (300) separated from the ejection chamber (100) and from the decoupling chamber (200) and being partly bounded by the first membrane (310) and the second membrane (420), the transmission chamber (300) is filled with a relatively incompressible fluid, and means to apply a force to the first membrane (310) and/or the second membrane (420).

2. A fluid ejection device according to claim 1, wherein the ejection chamber (100) has at least two openings, a first opening (120) for ejecting or pumping a fluid out of the ejection chamber (100) and a second opening connected to a supply tube (110) to refill the ejection chamber with the fluid.

3. A fluid ejection device according to claim 1, wherein at least one first electrode is attached to the second membrane (420), and at least one second electrode (410) is attached to the border of the transmission chamber (300).

4. A fluid ejection device according to claim 3, wherein a third electrode is attached to the first membrane (310) and the second electrode faces the first membrane (310) and the second membrane (420).

5. A fluid ejection device according to claim 4, wherein at least one electrode (430, 470) is attached to a side of the border of the ejection chamber (100) and/or the decoupling chamber (200) and faces the electrode or electrodes being attached to the first membrane (310) and/or the second membrane (420) and a voltage source is provided to apply a voltage between the electrode being attached to the first membrane (310) and the at least one electrode (430, 470) attached to a side of the border of the ejection chamber (100) and/or the decoupling chamber (200), and/or the electrode being attached to the second membrane (420) and the at least one electrode (430, 470) attached to a side of the border of the ejection chamber (100) and/or the decoupling chamber (200) that at least one further electrostatic force can be applied to the first membrane (310) and/or the second membrane (420).

6. A fluid ejection device according to claim 3, wherein a third electrode is attached to the border of the transmission chamber (300) facing the first membrane (310), the second electrode faces the second membrane (420), the first electrode (460) extends across the first membrane (310) and the second membrane (420) facing the second electrode and the third electrode.

7. A fluid ejection device according to claim 3, wherein a third electrode is attached to the border of the transmission chamber (300) facing the first membrane (310), a fourth electrode is attached to the first membrane (310), the second electrode faces the second membrane (420.

8. A fluid ejection device according to claim 3, wherein at least one pull back electrode (430) is attached to a side of the border of the decoupling chamber (200), and a voltage source is provided to apply a voltage between the first electrode being attached to the second membrane (420) and the pull back electrode (430) in a way that a pull back electrostatic force can be applied to the second membrane (420).

9. A fluid ejection device according to claim 1, wherein the relatively incompressible fluid filled in the transmission chamber (300) has a high permittivity.

10. A printing system comprising a fluid ejection device that includes an ejection chamber (100) with at least one opening (120) on at least one side of the ejection chamber and a first membrane (310) covering another side of the ejection chamber, a decoupling chamber (200) separated from the ejection chamber (100) and covered on one side with a second membrane (420), a transmission chamber (300) separated from the ejection chamber (100) and from decoupling chamber (200) and being partly bounded by the first membrane (310) and the second membrane (420), the transmission chamber (300) is filled with a relatively incompressible fluid, and means to apply a force to the first membrane (310) and/or the second membrane (420) according to claim 1.

11. A method for driving a fluid ejection device comprising an ejection chamber (100), a decoupling chamber (200) and a transmission chamber (300), a first membrane (310) partly bounding the transmission chamber (300) and the ejection chamber (100), a second membrane (420) partly bounding the decoupling chamber (200) and the transmission chamber (300), and an essentially incompressible liquid filled in the transmission chamber, which method comprises the following steps:

applying a force to the second membrane (420);

transmitting the force applied the second membrane (420) via the essentially incompressible liquid in the transmission chamber (300) to the first membrane (310);

applying a force to a fluid to be ejected filled in the ejection chamber (100) by means of the first membrane (310);

ejecting the fluid to be ejected filled in the ejection chamber (100) through an opening (120).

* * * * *